US006719100B2

(12) United States Patent
James, Jr. et al.

(10) Patent No.: US 6,719,100 B2
(45) Date of Patent: Apr. 13, 2004

(54) INTERFLOOR VERTICAL TRANSPORT AND HORIZONTAL CLOSURE SYSTEM

(75) Inventors: Albert P. James, Jr., Reading, MA (US); Joseph Reiss, Carlisle, MA (US)

(73) Assignee: PRI Automation, Inc., Billerica, MA (US)

( * ) Notice: Subject to any disclaimer, the term of this patent is extended or adjusted under 35 U.S.C. 154(b) by 40 days.

(21) Appl. No.: 09/943,425

(22) Filed: Aug. 30, 2001

(65) Prior Publication Data

US 2002/0032991 A1 Mar. 21, 2002

Related U.S. Application Data

(60) Provisional application No. 60/229,771, filed on Sep. 1, 2000.

(51) Int. Cl.[7] ..... B66B 13/16; B66B 13/00

(52) U.S. Cl. ..... 187/340; 187/336; 52/30; 414/940

(58) Field of Search ..... 187/336–341; 52/30; 414/940

(56) References Cited

U.S. PATENT DOCUMENTS

| | | | | | |
|---|---|---|---|---|---|
| 219,474 | A | * | 9/1879 | Holbrook | 187/339 |
| 355,285 | A | * | 12/1886 | Ward et al. | 187/339 |
| 373,554 | A | * | 11/1887 | Darrach | 187/339 |
| 490,328 | A | * | 1/1893 | Wallenstein | 187/339 |
| 6,135,698 | A | * | 10/2000 | Bonora et al. | 414/940 X |

* cited by examiner

*Primary Examiner*—James W. Keenan
*Assistant Examiner*—Thuy V. Tran
(74) *Attorney, Agent, or Firm*—Weingarten, Schurgin, Gagnebin & Lebovici LLP; Richard Pickreign

(57) ABSTRACT

A horizontal door system is used in conjunction with an interfloor vertical transport system that penetrates an opening in a floor. The vertical transport system has vertical elements that define a fixed horizontal cross-section within the opening, and the door system includes a leading edge profile having a configuration matching the fixed horizontal cross-section of the vertical transport system. The door system is particularly suitable as a fire door system to seal upper and lower fire zones.

38 Claims, 13 Drawing Sheets

INTERFLOOR VERTICAL TRANSPORT AND HORIZONTAL CLOSURE SYSTEM

CROSS REFERENCE TO RELATED APPLICATIONS

Benefit is claimed under 35 U.S.C. § 119(e) of U.S. Provisional Application No. 60/229,771 filed Sep. 1, 2000, the disclosure of which is incorporated herein by reference.

STATEMENT REGARDING FEDERALLY SPONSORED RESEARCH OR DEVELOPMENT

N/A

BACKGROUND OF THE INVENTION

Multi-floor semiconductor fabrication plants are commonplace, especially in Asia, where real estate is scarce. Thus, an interfloor transport system is required to move items between floors. Generally, an interfloor transport system must penetrate one or more fire isolation zones, which are solid concrete or masonry floors or ceilings, in the building. Building codes generally require that any floors within fabrication or hazardous material production areas be separated from each other by not less than one-hour fire resistive occupancy separations.

Vertical fire shafts and vertical fire doors are commonly used in fabrication areas where interfloor transport devices penetrate a fire zone floor. Vertical fire doors, which are required in every location where access is needed to the equipment within, typically generate particulates that can be difficult to remove or control in an environment that requires a high degree of cleanliness, such as semiconductor fabrication. Also, vertical fire doors must be fully cleared of people and equipment before they can be closed. The vertical shafts must also be large enough for personnel to enter for maintenance and repair tasks. Consequently, the vertical shafts require a large amount of floor space.

The elevator assembly within the shaft typically includes bearings and tracks or rails on the sides of the shaft and cabling in the middle of the shaft. A horizontal door cannot readily seal around such a dispersed arrangement of equipment. Horizontal openings through floors, if used at all, must be fully cleared of the transport system and payload before the opening can be sealed with a horizontal door.

SUMMARY OF THE INVENTION

The present invention relates to a horizontal door system for use in conjunction with an interfloor transport or elevator system installed through a horizontal opening in a floor or ceiling. The interfloor transport system includes a drive column incorporating tracks or guide rails on which a robot assembly rides. Accordingly, the tracks are located in an area generally closer to the cabling attached to the robot assembly than in prior art elevator assemblies. The drive column has an irregular profile formed by vertical elements that define a fixed horizontal cross-section within the opening. The horizontal door system is able to seal around the irregular profile of the drive column and any cabling present in the opening. The horizontal door system is particularly useful as a fire door separating fire zones. The door system is also capable of sealing off the fire zones even if equipment is present in the penetration in the floor.

In a preferred embodiment, the door system comprises an upper door assembly that closes the opening in the floor, a lower door assembly suspended below the floor, and an interconnecting plenum. The height of the interconnecting plenum between the upper and lower door assemblies is selected to be larger than the height of the equipment that travels along the drive column and any loop formed by the cabling. Thus, even if equipment were present within the opening in the floor during a fire emergency, the lower door assembly would be clear of any obstructions and could be closed, sealing the interior of the plenum and the upper zone from the lower zone. In addition, the upper and lower door assemblies preferably include an expandable intumescent fire sealing or gasketing material that seals around the drive column and the cabling if present within the opening.

In operation as a fire door system, the door system remains open under normal conditions and closes automatically when a selected condition is detected, such as an increase in temperature above, for example, 165° F., actuation of a smoke detector, or actuation of a fire alarm device. The fire door system is capable of limiting the passage of fire and smoke and the temperature rise across the horizontal surface for a predetermined period of time, for example, two hours for hazardous material production areas.

DESCRIPTION OF THE DRAWINGS

The invention will be more fully understood from the following detailed description taken in conjunction with the accompanying drawings in which.

DETAILED DESCRIPTION OF THE INVENTION

Figure 14:
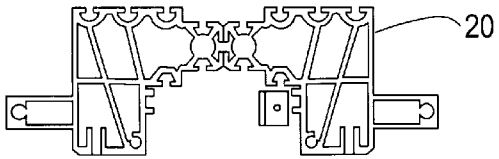
FIG. 14 is a top view of an extruded drive column of an interfloor transport system used with the horizontal door system of the present invention.

FIGS. 1–5 illustrate a horizontal door system 10 in operation as a fire door system according to the present invention. The horizontal door system is illustrated and preferably used in conjunction with an interfloor transport or elevator system 12 that penetrates an opening 14 in a concrete or masonry floor or ceiling 16, such as in a semiconductor fabrication facility. The interfloor transport system typically comprises equipment such as a robot assembly 18 that travels vertically along a drive column 20 that extends through the opening. The drive column is typically an extrusion having an irregular profile in cross section (see FIG. 14) to provide tracks or guides along which the robot assembly travels. Cabling 22 that extends from the robot assembly forms a loop of varying size as the robot assembly travels vertically along the column. A typical opening for an interfloor transport system is 750 mm by 900 mm.

At any moment, the robot assembly 18 and/or the cabling 22 may be present within the opening 14 in the floor. Accordingly, the horizontal door system includes an upper door assembly 24 that closes the opening in the floor, a lower door assembly 26 suspended below the floor, and an interconnecting plenum 28. The height of the interconnecting plenum between the upper and lower door assemblies is selected to be larger than the height of the robot assembly and any loop formed by the cabling. Thus, even if the robot assembly and/or the loop of cabling were present within the opening 14 in the floor 16 during a fire emergency, the lower door assembly 26 would be clear of any obstructions and could be closed, sealing the interior of the plenum and the upper zone 30 from the lower zone 32. In addition, the upper and lower door assemblies preferably include an expandable intumescent fire sealing or gasketing material that seals around the drive column 20 and the cabling 22 if present within the opening 14, as discussed further below.

The plenum 28 constitutes a box 40 of a fire-resistant material having an interior region 42 that conforms in horizontal cross-section to the opening 14 in the floor 16. The plenum surrounds the drive column 20, and the robot assembly 18 travels through the plenum along the drive column. The plenum includes four sealed walls 40*a*, 40*b*, 40*c*, 40*d*, of a length sufficient to contain the robot assembly 18 and cabling 22 between open upper and lower ends 44, 46. The plenum is sealingly mounted to the floor at its upper end in any suitable manner. A portion of the plenum walls 40*a*, 40*b*, 40*c*, 40*d*, extends a small distance above the upper surface.

The upper door assembly 24 is shown more particularly in FIGS. 6–13. The upper door assembly includes a generally rectangular frame 50 mounted to the extending portion of the plenum walls. The frame includes two opposed side members 52, 54 and interconnecting cross pieces 56. Other structural members may be provided as needed. The side members, each provided as two pieces 52*a*, 52*b*, 54*a*, 54*b*, suitably joined in the embodiment shown, extend beyond the opening in the floor and plenum. Guide tracks 58 are mounted along opposing inner faces of the side members.

A door is mounted within the frame. In the embodiment illustrated, the door constitutes a two-piece door. A longer door piece 62 is provided on the side of the drive column 20 on which the opening is located through which the robot assembly passes. A shorter door piece 64 is provided on the opposite side of the drive column. The door pieces together are sized to cover and seal the opening in the floor and the plenum and are biased toward the drive column to converge and overlie these openings with respective automatic closure mechanisms 70, described further below. The door pieces include a suitable number of slides 66 that ride on the tracks 58 extending along the side members 52, 54 of the frame 50. During normal conditions, respective anchorage mechanisms 68 hold the door pieces 62, 64 against the closure mechanisms 70 clear of the opening to allow passage of the robot assembly through the opening, as discussed further below. In the figures, the longer door piece 62 is shown in the open position and the shorter door piece 64 is shown in the closed position.

The door pieces 62, 64 are formed of upper and lower face sheets 76, preferably of a minimum 20 gauge (0.032 in) steel, secured to peripheral steel members 78 to form a panel. A suitable panel thickness is, for example, 1¾ inch (44 mm). The steel panel may contain steel stiffeners, fire insulation, or noncombustible fire resistive core materials, as would be known in the art.

Sealing strips 72, such as brush seals or neoprene lip seals, and intumescent fire sealing material 74 are provided in channels between the frame and door pieces and along the sides of the door pieces. Upon activation, the intumescent material expands and fills any voids between the door pieces and the frame. The intumescent fire sealing material expands greatly in volume when the temperature rises above its activation temperature. Typically the volume expansion is five to ten times. A suitable intumescent fire sealing material is available from Zero International, which activates when the temperature rises above 165° F.

Figure 15:
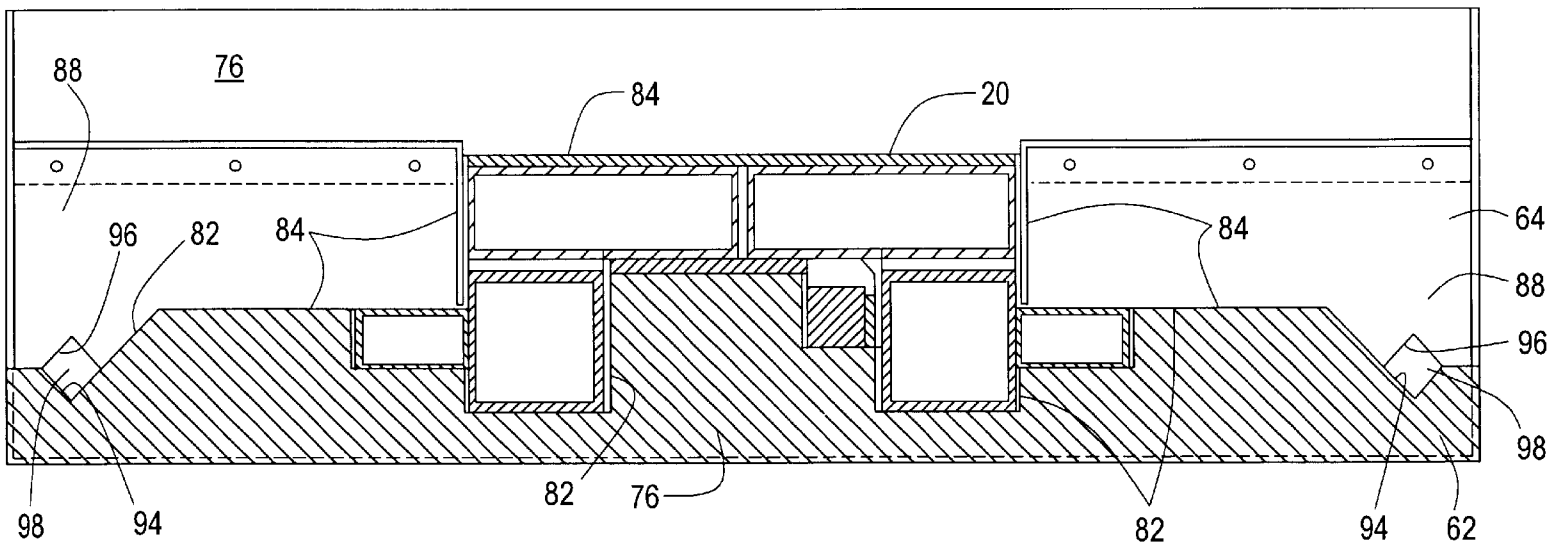
FIG. 15 is a partial cross-sectional view of a drive column with the horizontal door system in a closed position.

The drive column 20 typically has an irregular profile in cross-section. To accommodate this profile, the door pieces 62, 64 include leading edges 82, 84 that are contoured to fit at least generally around the irregular column 20 in the closed position. (See FIG. 15.) The leading edges may be formed by separate nose portions or weldments 86, 88 attached to the steel panels. The front of the column 20 has an irregular profile in cross-section to accommodate traveling of the robot assembly. The leading edge 82 of the longer door piece 62 has a matching irregular profile. The two door pieces 62, 64 converge on the sides of the column 20. A latch mechanism 88, 90 to hold the door pieces together is preferably provided. The door pieces may have any suitable profile, depending on the equipment around which they must fit. Similarly, only a single door piece may be used if acceptable.

Figure 1:
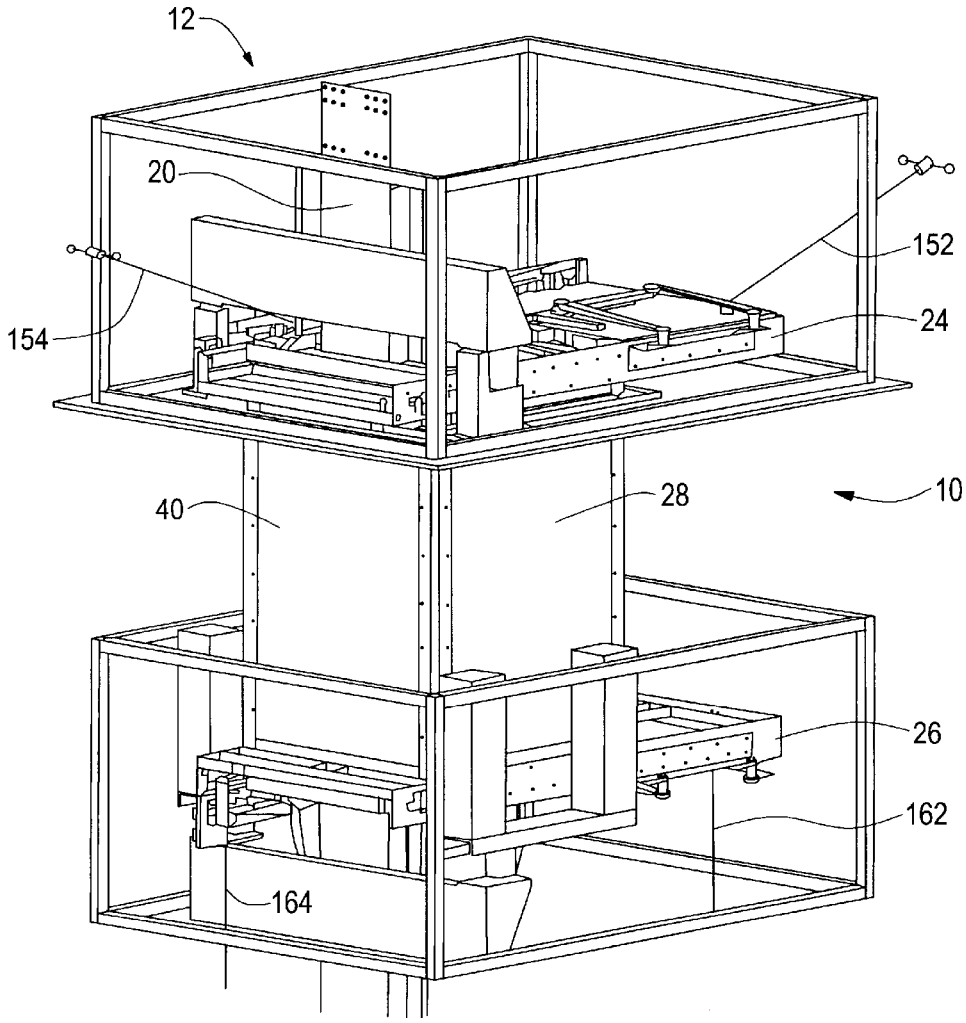
FIG. 1 is an isometric view of a horizontal door system in conjunction with an interfloor transport system according to the present invention.
Figure 2:
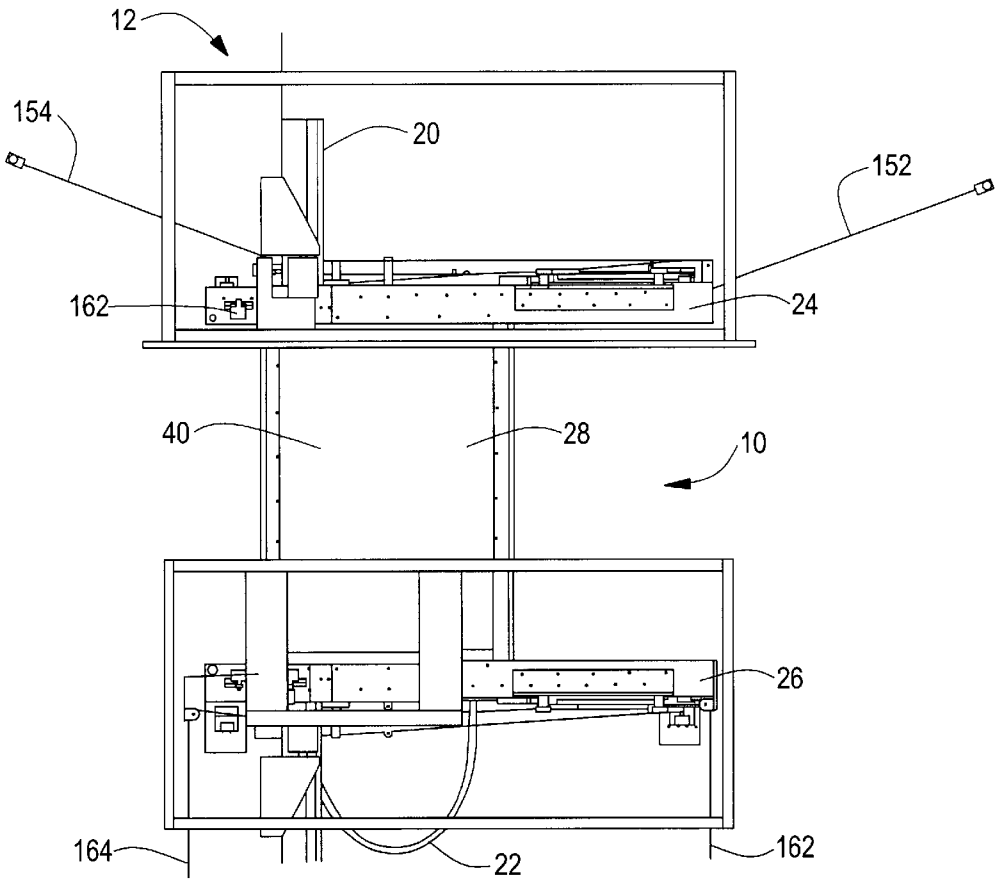
FIG. 2 is a side view of the horizontal door system of FIG. 1.
Figure 3:
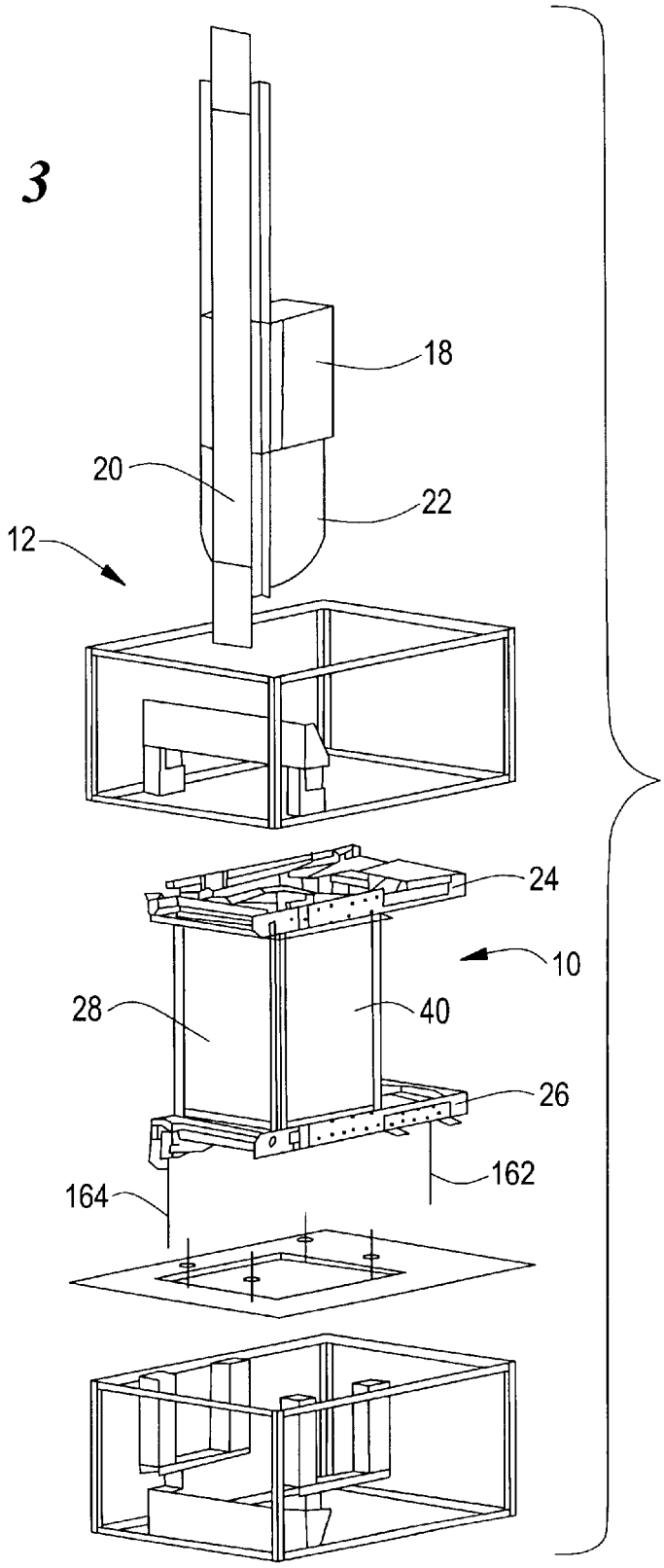
FIG. 3 is an exploded view of the horizontal door system of FIG. 1.
Figure 4:
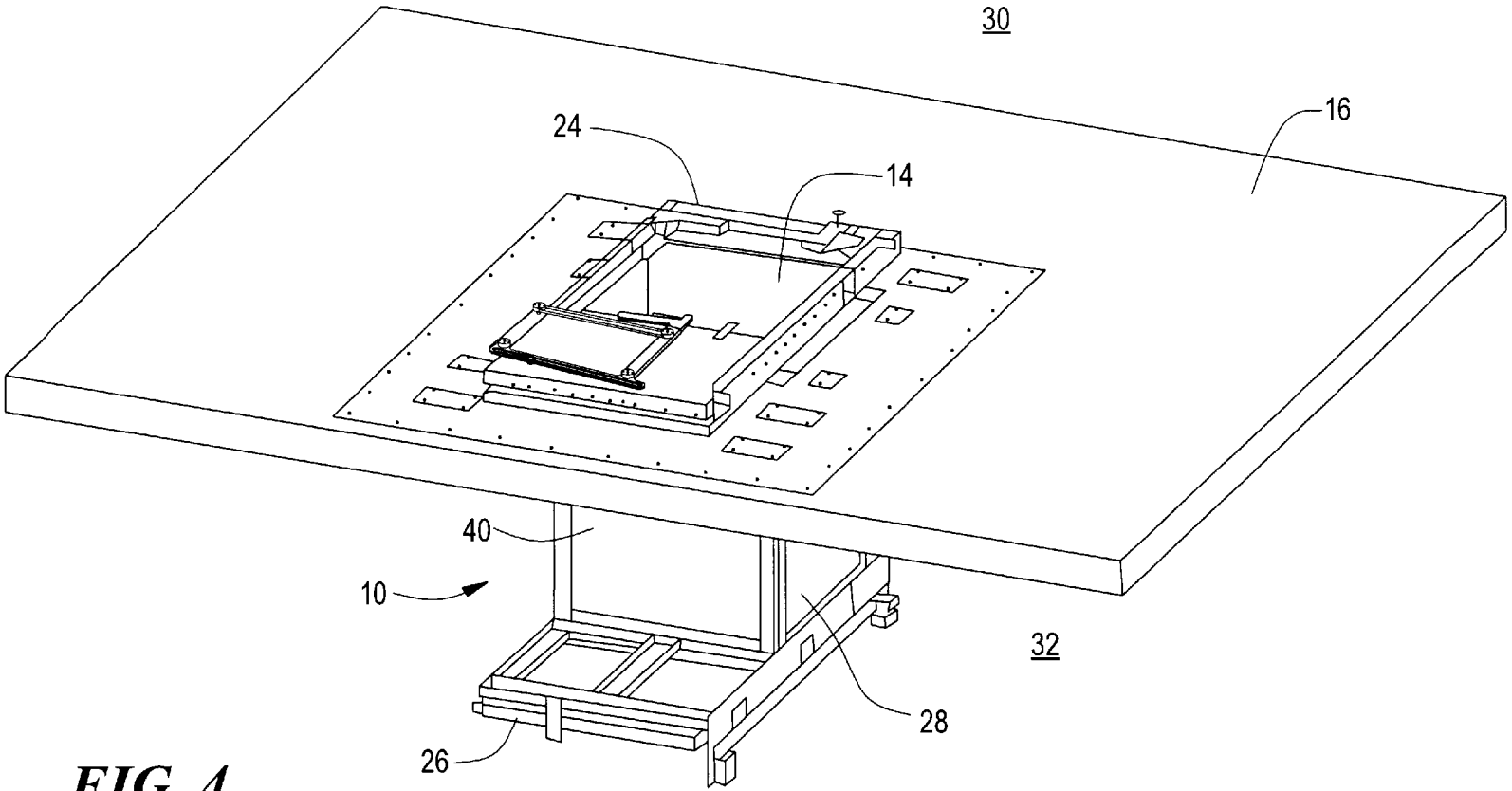
FIG. 4 is an isometric view of the horizontal door system of FIG. 1 in which the interfloor transport system has been removed.
Figure 5:
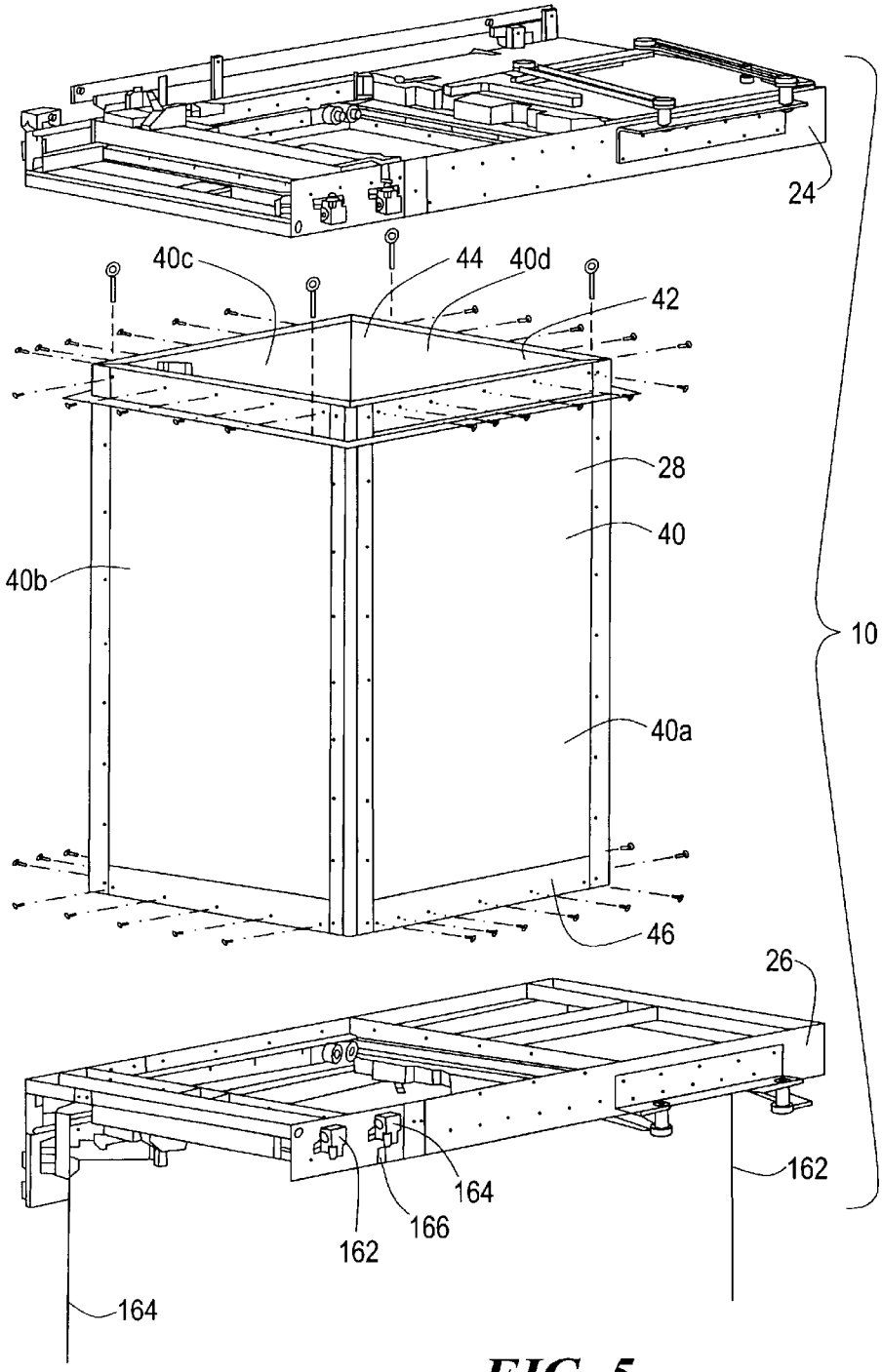
FIG. 5 is an exploded view of the horizontal door system of FIG. 4.
Figure 6:
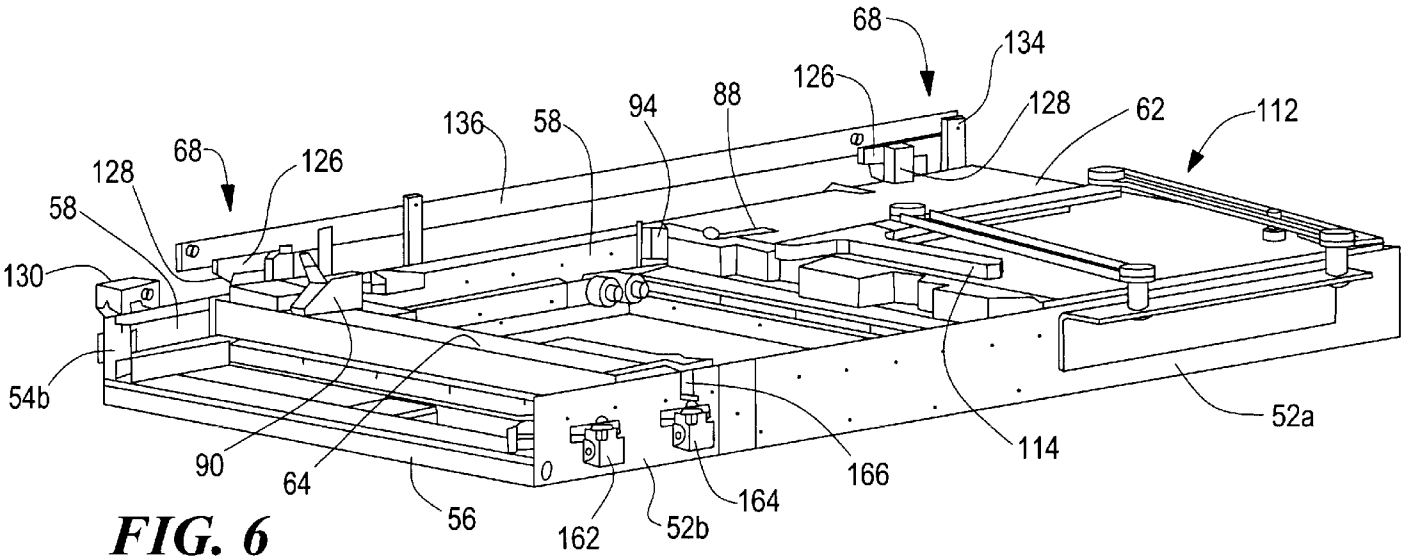
FIG. 6 is an isometric view of the upper door assembly of the FIG. 1.
Figure 9:
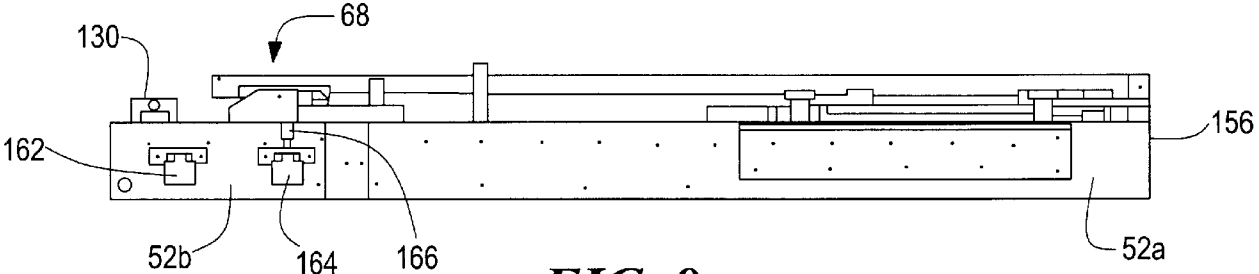
FIG. 9 is a side view of the upper door assembly of FIG. 6.
Figure 7:
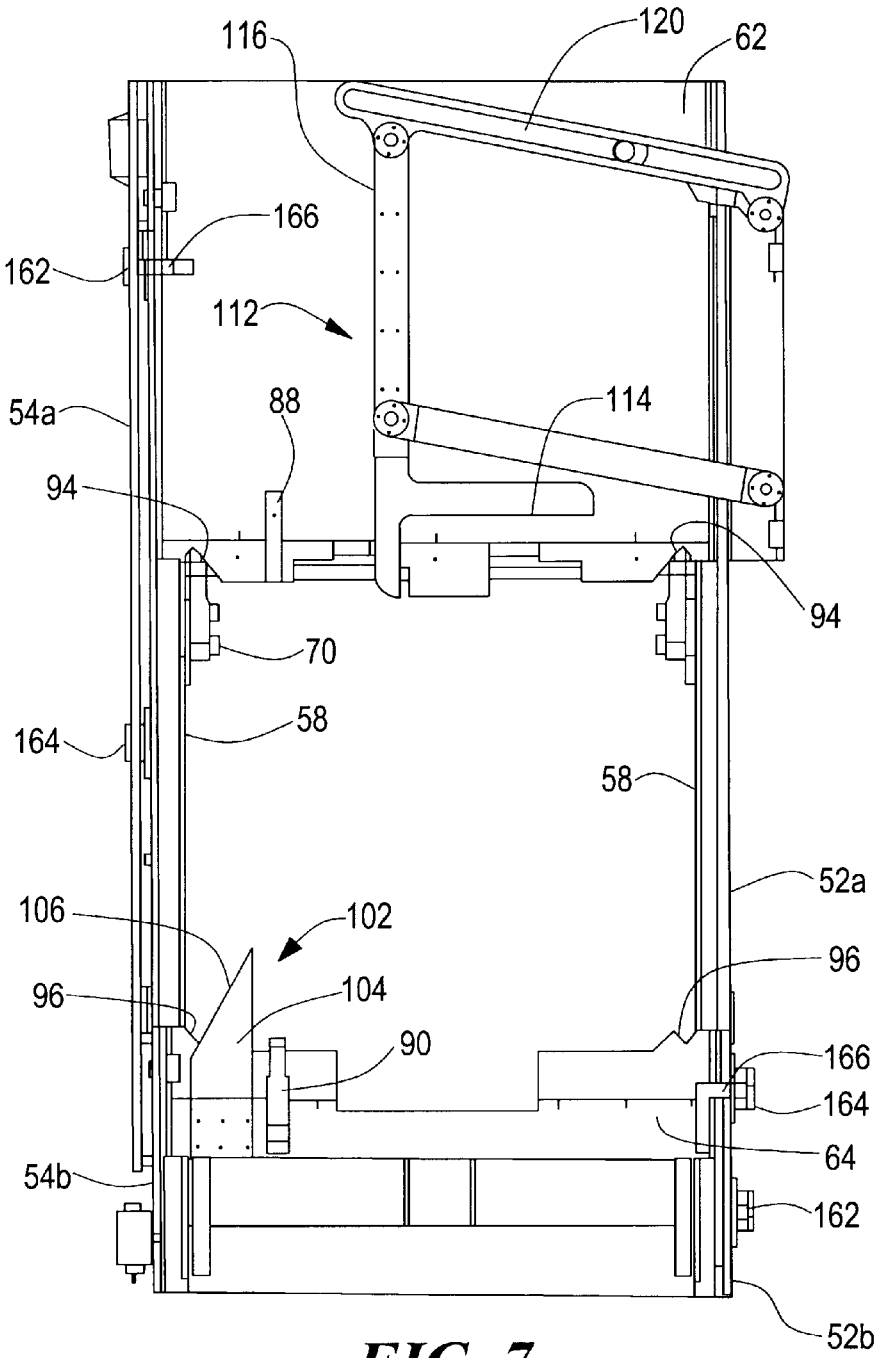
FIG. 7 is a top view of the upper door assembly of FIG. 6.
Figure 8:
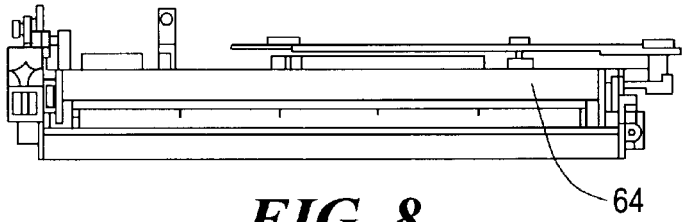
FIG. 8 is an end view of the upper door assembly of FIG. 6.
Figure 10:
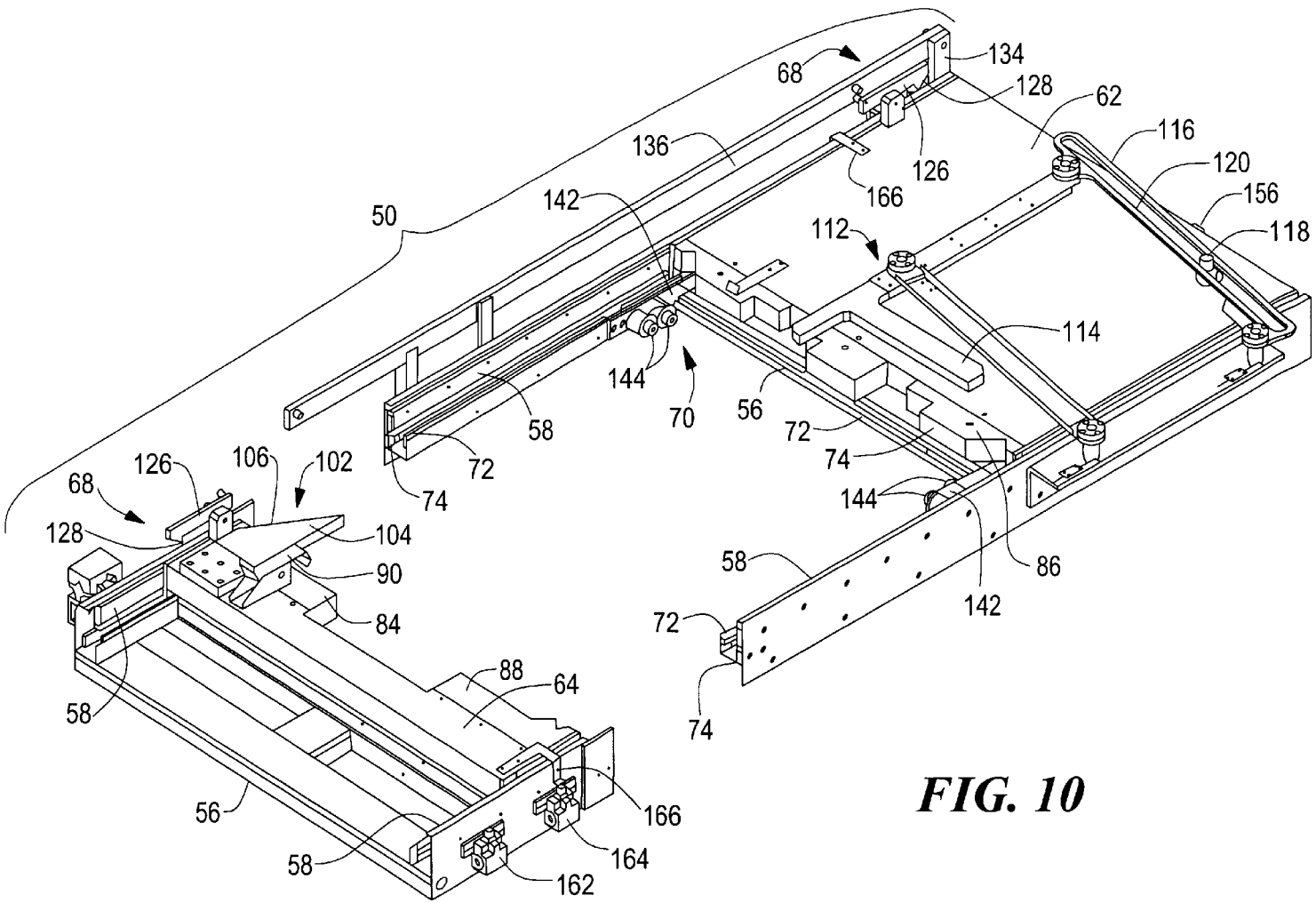
FIG. 10 is an exploded view of the upper door assembly of FIG. 6.
Figure 11:
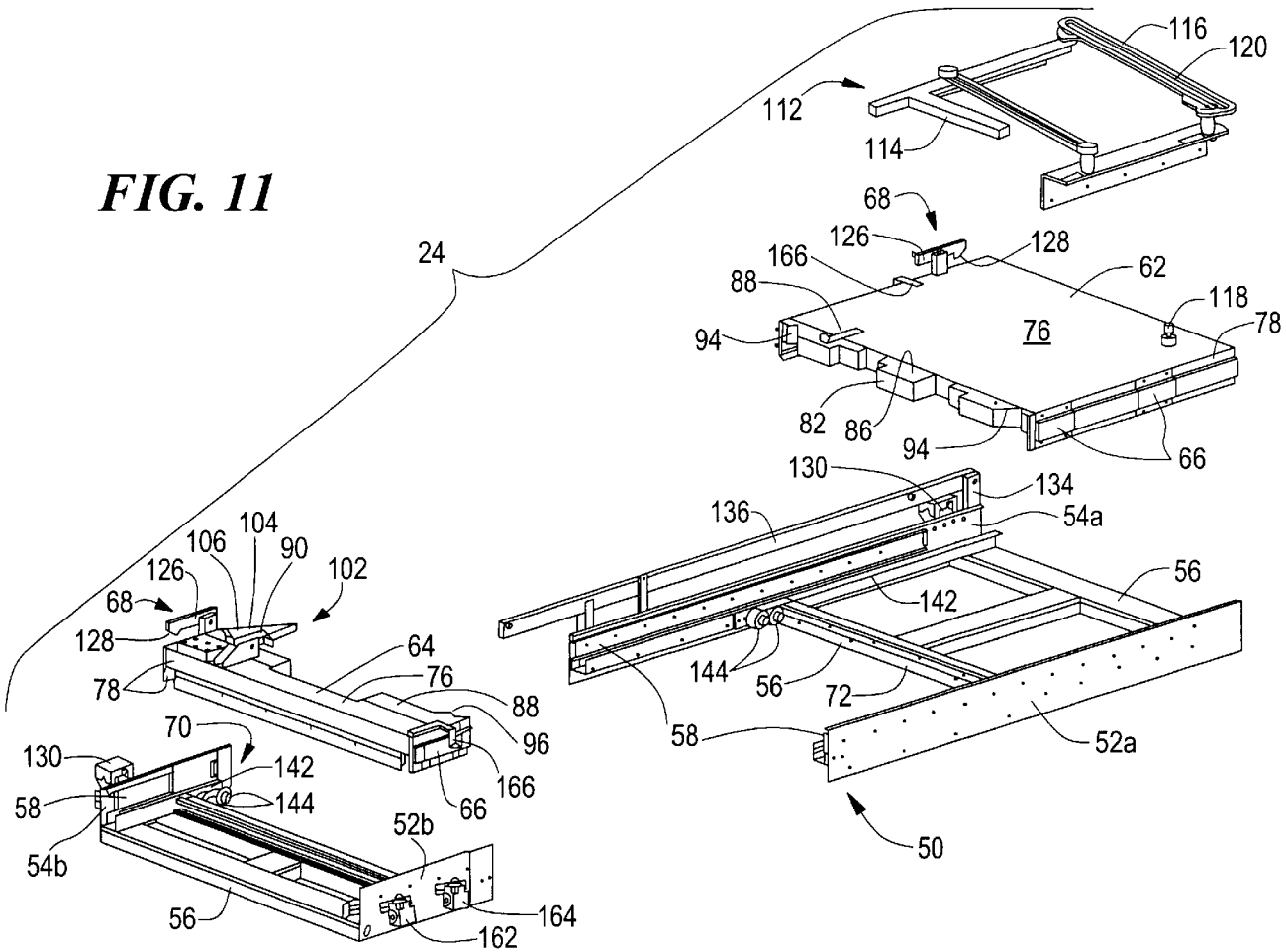
FIG. 11 is a further exploded view of the upper door assembly of FIG. 6.
Figure 12:
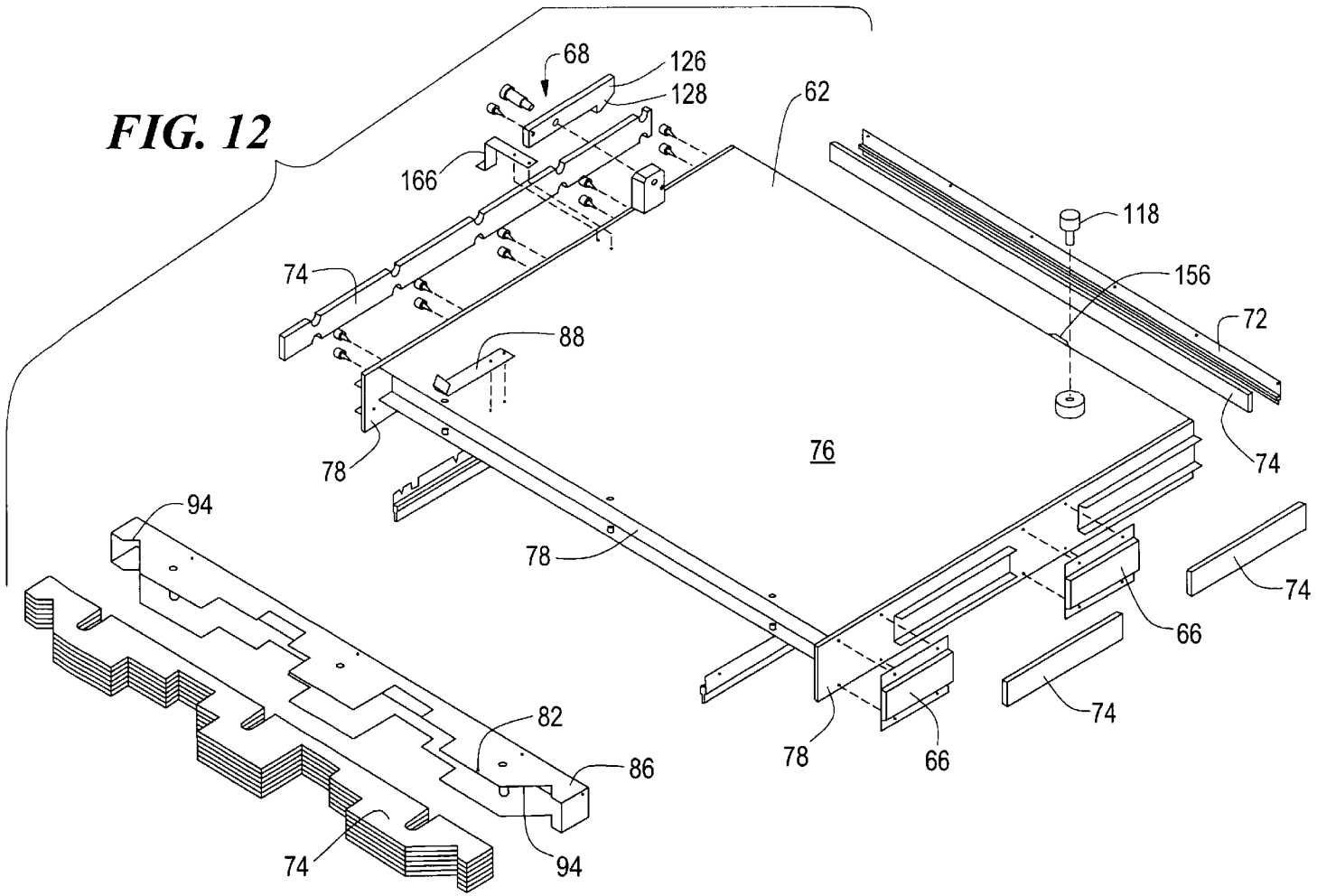
FIG. 12 is an exploded view of the larger door piece of the upper door assembly of FIG. 6.
Figure 13:
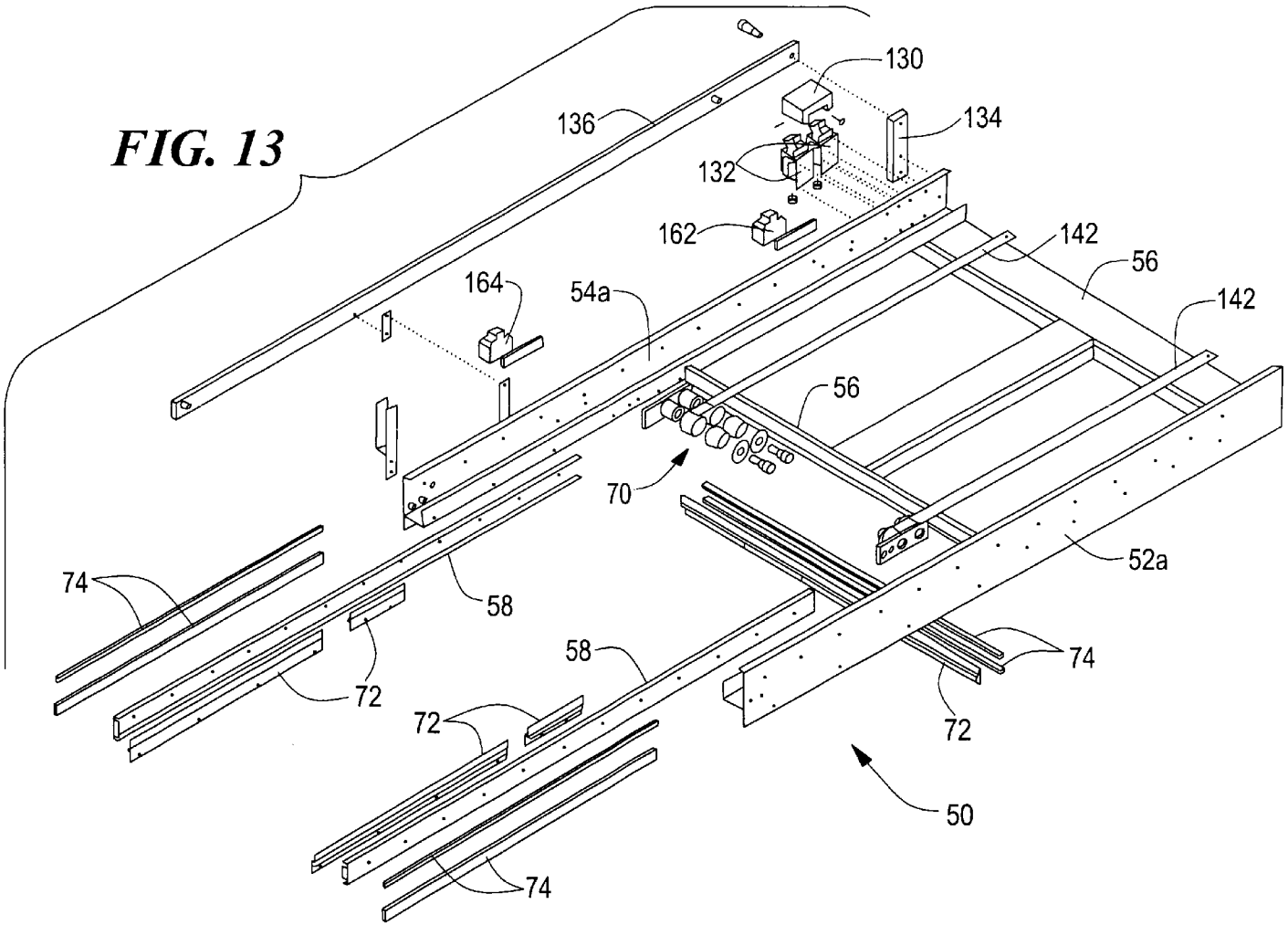
FIG. 13 is an exploded view of the larger door frame assembly of FIG. 6.

As best seen in FIG. 12, the nose portions 86, 88 are open facing the column. Intumescent fire sealing material 74 is placed within the interior of the nose portions exposed through the open side. The intumescent material expands upon activation around the irregular profile of the drive column 20 and any cabling 22 within the opening, sealing the zone above the opening from the interior region of the plenum and the zone below. The drive column 20 typically includes a number of small recesses or irregularities, for structural requirements and due to its extruded nature. See FIG. 14. The intumescent material when expanded is able to fill these smaller recesses.

The leading edge 82 of the longer door piece 62 includes two notched regions 94 on each side of the drive column, and the leading edge 84 of the shorter door piece 64 includes corresponding notched regions 96. When the door pieces are closed around the drive column, the notched regions align to form diamond-shaped spaces 98 in which the two portions of the loop of the cabling 22 are received. See FIG. 15. A fixed guide 102 is provided on one side to direct one portion of the cable loop into one of the diamond-shaped spaces 98. The fixed guide includes a guide arm 104 fixed to the shorter piece 64 and having a face 106 located to catch the loop and direct it into the space 98. A movable guide 112 is mounted on the longer door piece 62 to direct the other loop of the cable into the other diamond-shaped space 98. The movable guide includes a guide arm 114 connected to the door piece with a parallelogram linkage 116 mounted to the frame 50. A cam follower 118 on the door piece follows a cam surface 120 on one of the links as the door piece closes, moving the guide arm 114. The moving guide arm catches the other loop and directs it to the other diamond-shaped space 98 as the larger door piece closes. During a fire, the voids in the diamond-shaped spaces 98 surrounding the cable are subsequently filled with the expanded intumescent fire sealing material 74.

As noted above, the door pieces 62, 64 are held open against the automatic closure mechanism 70 by the anchorage mechanism 68. The anchorage mechanism is activated to release the door pieces upon a signal received from a heat, smoke, or fire detector. The heat detector may be a fusible link made of a metal that melts at a temperature of 165° F. or greater. The smoke, fire, and/or heat detectors are preferably located in accordance with applicable published standards, such as NFPA-80, FMRC data sheet 1.23.

In the embodiment illustrated, the anchorage mechanism 68 for each door piece includes a pivotable arm 126 having a lip or catch 128 biased to latch beneath a corresponding counterweight 130 on the frame 50. The counterweight is held in the biased position by one or more energized solenoids 132. The counterweight for the longer door piece 62 is also retained in the latched position by a fusible link 134 attached to a pivotable arm 136. Upon detection of a fire situation, the link 134 breaks and the solenoids 132 are de-energized, causing the counterweight to spring up, thereby releasing the catch 128 on the arm 126 and allowing the door piece to close. Any other suitable anchorage mechanism may be used, as would be appreciated by those of skill in the art.

The automatic closure mechanism 70 of the embodiment illustrated includes a constant force or negative spring member 142 on each side of each of the door pieces 62, 64. One end is attached to and supported by flanged sleeve bearings 144 mounted on the frame 50 at a location near the leading edge of the respective door piece in the open position. The other end of the spring member is attached to the door piece near its trailing edge. The spring member is biased to pull the door closed. Preferably the tracks 58 are also inclined at a slight downward angle toward the opening to allow for gravity closure. The angle is approximately 5–10° and preferably ¾ in/ft (63 mm/m). When activated, the door must close at a rate of 6 to 24 in/sec (0.15 to 0.6 m/s) with a ten-second time delay, to comply with NFPA 80 guidelines. Any other suitable closure mechanism may be provided, as would be appreciated by those of skill in the art. For example, the closure mechanism may incorporate a counterweight system or a powered closure.

The door assembly is preferably capable of being tested upon installation and at least annually thereafter to simulate a fire situation and to ensure that the automatic closure mechanism is in proper working condition. A reset mechanism is provided to move the door pieces back into the open, anchored position. The reset mechanism includes handles 152, 154 attachable to each door piece 62, 64. The handle 152 attaches to an eye 156 on the trailing edge of the longer door piece 62. The handle 154 attaches to the latch member 90 to unlatch the two door pieces 62, 64 from each other. An operator pulls each handle to pull the associated door piece open until the anchorage mechanism 68 latches and holds the door open. It will be appreciated that any other suitable reset mechanism may be provided.

Sensors or switches are preferably provided to detect whether the door pieces are in the open or closed position. For example, limit switches 162 mounted on the frame 50 when contacted by switch brackets 166 on the door pieces detect the door piece in the open position. Limit switches 164 when contacted by the switch brackets 166 detect the door piece in the closed position.

Figure 16:
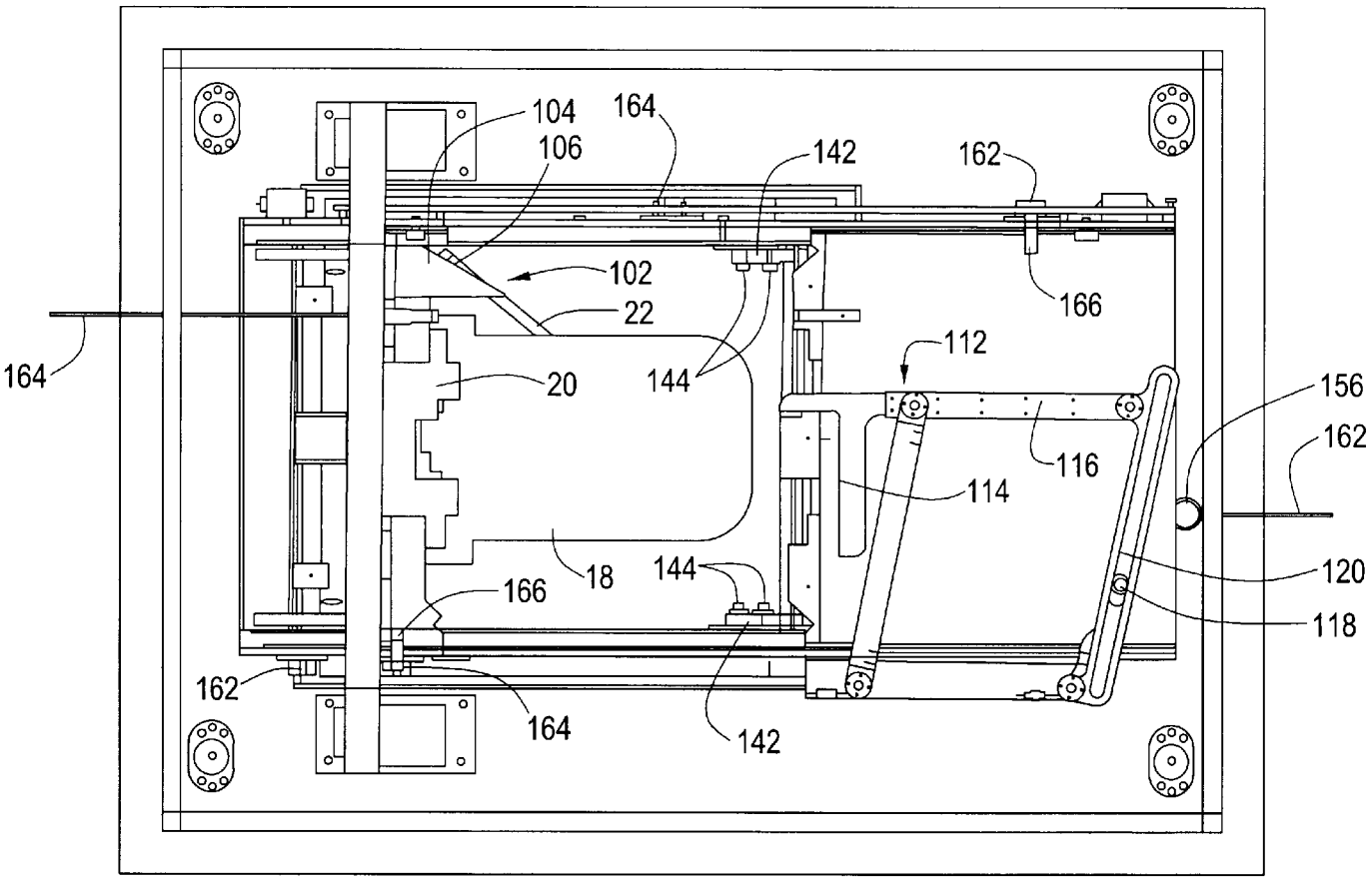
FIG. 16 is a bottom view of the lower door assembly of FIG. 1.

The lower door assembly 26 is substantially the same as the upper door assembly, although it is oriented upside down. See FIG. 16. Like reference numerals are used to identify like elements. The reset mechanism of the lower door assembly is also preferably substantially similar to the reset mechanism of the upper door assembly. However, because the lower door assembly is elevated from the floor below and difficult to reach directly, the lower door assembly preferably includes hanging handles 162, 164 that can be reached from the floor below. An operator grasps and pulls the hanging handle to unlatch the door pieces from each other and move the door pieces until they anchor into the open position. It will be appreciated that any other suitable reset mechanism may be provided.

It will be appreciated that many modifications can be made to the present invention. For example, the interfloor transport system or elevator system may have a different configuration from that shown, and the door pieces and frame may be modified to fit the particular configuration around which they must seal. Only the upper door system in the floor may be needed. Only a single door piece may be needed, rather than two door pieces as shown. Different nose portion configurations may be appropriate. Similarly, the guide arms for the cabling may be modified as necessary to accommodate the particular configuration around which the door system must seal. The invention is not to be limited by what has been particularly shown and described, except as indicated by the appended claims.

What is claimed is:

1. An interfloor vertical transport and horizontal closure system comprising:

a vertical transport system extendable through an opening in a floor or ceiling, the vertical transport system comprising vertical elements defining a fixed horizontal cross-section within the opening; and a horizontal door system operative to seal the opening in the floor or ceiling comprising a door assembly comprising a frame mountable adjacent the opening surrounding the vertical transport system and a door movably mounted to the frame to travel in a horizontal plane to seal the opening in the floor, the door including a leading edge profile having a configuration matching a configuration of an opposed portion of the fixed horizontal cross-section of the vertical elements of the vertical transport system, the door oriented horizontally with the leading edge profile disposed in opposition to the opposed portion of the fixed horizontal cross-section.

2. The system of claim 1, wherein the vertical transport system further comprises a drive column and a robot assembly operable to travel vertically along the drive column.

3. The system of claim 2, wherein the drive column comprises an extrusion.

4. The system of claim 2, wherein the drive column includes track elements on which the robot assembly travels.

5. The system of claim 2, wherein, the vertical transport system further comprises cabling extending from the robot assembly in a loop, and the leading edge profile of the door further includes a cable-receiving notch configured to receive a portion of the loop of the cabling.

6. The system of claim 5, further comprising a guide disposed to direct the portion of the loop of the cabling into the notch.

7. The system of claim 5, further comprising a guide fixed in opposition to the leading edge profile and configured to direct the portion of the loop of the cabling into the notch.

8. The system of claim 5, further comprising a guide movably mounted on the door and configured to direct the portion of the loop of the cabling into the notch.

9. The system of claim 8, wherein the movably mounted guide comprises a guide arm connected to the door with a linkage mounted to the frame.

10. The system of claim 5, wherein the leading edge profile of the door further includes a second cable-receiving notch configured to receive a further portion of the loop of the cabling.

11. The system of claim 10, further comprising a first guide disposed to direct the portion of the loop into one of the cable-receiving notches and a second guide disposed to direct the further portion of the loop into another of the cable-receiving notches.

12. The system of claim 1, wherein the vertical transport system further comprises a semiconductor wafer transport system.

13. The system of claim 1, wherein the door assembly further comprises a closure mechanism disposed to bias the door into a closed position to cover the opening.

14. The system of claim 13, wherein the closure mechanism comprises a spring member having one end mounted near a trailing edge of the door and another end mounted to the frame near the leading edge of the door when the door is in the open position, the spring member biased to pull the door closed.

15. The system of claim 1, wherein the door assembly further comprises an anchorage mechanism disposed to releasably retain the door in an open position uncovering the opening.

16. The system of claim 15, wherein the anchorage mechanism comprises an arm movably mounted to the door and a counterweight movably mounted to the frame, the arm disposed to latch to the counterweight when the door is in the open position.

17. The system of claim 1, further comprising an actuator operative to move the door to a closed position.

18. The system of claim 1, wherein the horizontal door system further comprises:

a plenum mounted to the door assembly and suspended to depend below the opening in the floor or ceiling; and a lower door assembly connected to a lower end of the plenum and including a door movably mounted to close a lower end of the plenum.

19. The system of claim 1, wherein the door assembly further comprises a second door movably mounted to the frame in opposition to the door, the door and the second door disposed to converge around the vertical transport system.

20. The system of claim 1, wherein the horizontal door system comprises a fire door system.

21. The system of claim 1, further comprising intumescent fire sealing material disposed within a recess along the leading edge profile of the door.

22. The system of claim 1, further comprising intumescent fire sealing material disposed within channels between the door and the frame.

23. The system of claim 1, wherein the frame further comprises guide tracks, the door disposed to travel along the guide tracks of the frame.

24. An interfloor vertical transport and horizontal closure system comprising:

a vertical transport system extendable through an opening in a floor or ceiling, the vertical transport system comprising a drive column comprising vertical elements defining a fixed horizontal cross-section within the opening, the vertical transport system further comprising a robot assembly operable to travel vertically along the drive column; and a horizontal door system operative to seal the opening in the floor or ceiling comprising a door assembly comprising a frame mountable adjacent the opening surrounding the vertical transport system and a door movably mounted to the frame to seal the opening in the floor, the door including a leading edge profile having a configuration matching a configuration of an opposed portion of the fixed horizontal cross-section of the vertical elements of the drive column.

25. The system of claim 24, wherein the drive column comprises an extrusion.

26. The system of claim 24, wherein the drive column includes track elements on which the robot assembly travels.

27. The system of claim 24, wherein the vertical transport system further comprises cabling extending from the robot assembly in a loop, and the leading edge profile of the door further includes a cable-receiving notch configured to receive a portion of the loop of the cabling.

28. The system of claim 24, wherein the horizontal door system comprises a fire door system.

29. The system of claim 24, further comprising intumescent fire sealing material disposed within a recess along the leading edge profile of the door.

30. The system of claim 24, wherein the door assembly further comprises a second door movably mounted to the frame in opposition to the door, the door and the second door disposed to converge around the drive column of the vertical transport system.

31. An interfloor vertical transport and horizontal closure system comprising:

a vertical transport system extendable through an opening in a floor or ceiling, the vertical transport system comprising vertical elements defining a fixed horizontal cross-section within the opening; and a horizontal door system operative to seal the opening in the floor or ceiling comprising:

a door assembly comprising a frame mountable adjacent the opening surrounding the vertical transport system and a door movably mounted to the frame to seal the opening in the floor, the door including a leading edge profile having a configuration matching a configuration of an opposed portion of the fixed horizontal cross-section of the vertical transport system, a plenum mounted to the door assembly and suspended to depend below the opening in the floor or ceiling, and a lower door assembly connected to a lower end of the plenum and including a door movably mounted to close a lower end of the plenum.

32. The system of claim 31, wherein the horizontal door system comprises a fire door system.

33. An interfloor vertical transport and horizontal closure system comprising:

a vertical transport system extendable through an opening in a floor or ceiling, the vertical transport system comprising vertical elements defining a fixed horizontal cross-section within the opening; and a horizontal door system operative to seal the opening in the floor or ceiling comprising a door assembly comprising:

a frame mountable adjacent the opening surrounding the vertical transport system, a first door movably mounted to the frame to seal the opening in the floor, the first door including a leading edge profile having a configuration matching a configuration of an opposed portion of the fixed horizontal cross-section of the vertical transport system, and a second door movably mounted to the frame in opposition to the first door, the first door and the second door disposed to converge around the vertical transport system.

34. The system of claim 33, wherein the horizontal door system comprises a fire door system.

35. The system of claim 33, wherein the vertical transport system further comprises cabling hanging in a loop, and the first door and the second door include complementary cable-receiving notches disposed in alignment to provide a cable-receiving space when the first door and the second door are in a closed position.

36. The system of claim 33, wherein the vertical transport system further comprises cabling hanging in a loop, and the first door and the second door include a pair of complementary cable-receiving notches disposed in alignment to provide a pair of cable-receiving spaces when the first door and the second door are in a closed position.

37. The system of claim 36, further comprising:

a fixed guide mounted to the second door, the fixed guide disposed to direct a portion of the loop of the cabling into one of the spaces; and a movable guide mounted to the first door, the movable guide disposed to direct a portion of the loop of the cabling into another of the spaces.

38. The system of claim 33, further comprising intumescent fire sealing material disposed within a recess along the leading edge profile of the first door and within a recess along a leading edge profile of the second door.

* * * * *